United States Patent [19]

Nakamura et al.

[11] Patent Number: 4,476,092

[45] Date of Patent: Oct. 9, 1984

[54] METHOD FOR ADJUSTING THE HUMIDITY OF GAS TO A CONSTANT VALUE

[75] Inventors: Osamu Nakamura, Ikeda; Isao Ogino, Minoo; Teruo Kodama, Ikeda, all of Japan

[73] Assignees: Agency of Industrial Science and Technology; Ministry of International Trade and Industry, both of Tokyo, Japan

[21] Appl. No.: 128,150

[22] Filed: Mar. 7, 1980

[30] Foreign Application Priority Data

Mar. 30, 1979 [JP] Japan ..... 54-38478

[51] Int. Cl.[3] ..... A61L 9/00

[52] U.S. Cl. ..... 422/4; 261/22; 261/125

[58] Field of Search ..... 261/125, DIG. 17, 22; 55/247; 422/4

[56] References Cited

U.S. PATENT DOCUMENTS

| | | | |
|---|---|---|---|
| 1,589,428 | 6/1926 | Rosenow | 422/4 |
| 1,594,947 | 8/1926 | Hartman et al. | 261/125 X |
| 2,733,957 | 2/1956 | Van Buren | 422/4 X |
| 3,065,043 | 11/1962 | Kelley | 422/4 |
| 3,505,989 | 4/1970 | Truhan | 422/4 X |
| 3,528,781 | 9/1970 | Gelfman et al. | 422/4 X |
| 3,936,283 | 2/1976 | Solis | 422/4 X |
| 4,005,999 | 2/1977 | Carlson | 261/125 X |

FOREIGN PATENT DOCUMENTS

| | | | |
|---|---|---|---|
| 843294 | 6/1939 | France | 55/247 |

*Primary Examiner*—Richard L. Chiesa

*Attorney, Agent, or Firm*—Oblon, Fisher, Spivak, McClelland & Maier

[57] ABSTRACT

The humidity of a gas is adjusted by passing the gas through a plurality of compartments containing the saturated aqueous solution of a salt thereby imparting a prescribed value of humidity to the gas.

8 Claims, 2 Drawing Figures

METHOD FOR ADJUSTING THE HUMIDITY OF GAS TO A CONSTANT VALUE

BACKGROUND OF THE INVENTION

This invention relates to a method for adjusting the relative humidity (hereinafter referred to simply as "humidity") of gas to a fixed value.

Within a tightly closed space, retention of a gas at a fixed humidity can be effected rather easily by use of a saturated aqueous solution. In retaining a gas within a container at a fixed humidity by continuously introducing into the container gas having a substantially constant humidity, however, a large volume of the gas must be continuously supplied to the container. This supply of the gas proves to be quite difficult.

It has been customary to control the humidity of a given gas by means of a constant temperature vessel which incorporates a humidifier and a dehumidifier. In this constant temperature vessel, the gas is automatically maintained at a constant humidity by having the humidifier and the dehumidifier properly started or stopped alternately by means of a sensor and a controller. This method of humidity control, however, requires adoption of a prohibitive apparatus.

An expeditious measure resorted to for the regulation of the humidity of a gas involves the use of two containers, one filled with sulfuric acid and the other with water. A given gas whose humidity is desired to be regulated is divided into two streams, one stream to be passed through the container filled with sulfuric acid and the other stream through the container filled with water, whereafter the streams from the two containers are combined and mixed. It may appear that it would be possible to freely vary the humidity of the mixed gas by suitably selecting the ratio at which the gas is divided into the two streams prior to passage through the two respective containers so that the humidity of the gas could be readily regulated automatically. In actuality, however, it is extremely difficult to have the gas introduced accurately at prescribed ratios into the two containers solely by manual handling of cocks adapted to adjust the apertures in the respective feed pipes. The manual handling of these cocks is quite susceptible of error. Further, the humidity cannot easily be kept at a constant value because the pressure of the saturated vapor is variable with the ambient temperature. This fact constitutes itself another drawback for the method under discussion.

One object of this invention is to provide a method for stably and easily adjusting the humidity of gas to a constant value.

Another object of this invention is to provide an apparatus for easily adjusting the humidity of gas to a constant value.

SUMMARY OF THE INVENTION

To accomplish the objects described above according to the present invention, there is provided a method which effects the adjustment of the humidity of gas to a constant value simply by causing the gas to be kept in contact with a saturated aqueous solution of a salt for an ample length of time so that the humidity of the gas will come to approximate the humidity exhibited by the salt. An apparatus which is used for working the aforementioned method comprises a closed container provided at the upper opposite ends thereof respectively with an inlet for feed gas and an outlet for treated gas and further provided in the interior thereof with two sets of alternately disposed spaced vertical partition walls, the walls of one set having openings at the upper end and the walls of the other set having openings at the lower end. In this apparatus, the saturated aqueous solution of salt is placed to close all but the last lower opening in the partition walls. When the gas is introduced via the inlet and passed through the container, it comes into contact with the saturated aqueous solution of salt as often as it passes through the lower openings in the partition walls kept closed by the saturated aqueous solution. By the time the gas emanates from the outlet, it has acquired humidity of the value exhibited by the salt. The humidity thus imparted to the treated gas can easily be adjusted within the range of from 40 to 100% RH (at 20° C.) by suitably selecting the kind of salt to be used. The treatment permits the treated gas to acquire a prescribed value of humidity readily without entailing any fluctuation.

The other objects and characteristics of the present invention will become apparent from the further disclosure of the invention to be given hereinafter with reference to the accompanying drawing.

DESCRIPTION OF PREFERRED EMBODIMENT

The inventors continued a prolonged study in search of a simple and inexpensive apparatus for automatic regulation of the humidity of a gas. In the course of the study, they took notice of the phenomenon that when the saturated aqueous solution of a salt is present inside a closed container, the aerial phase of the interior of the container retains a fixed value of humidity. This knowledge encouraged them to conceive an entirely novel idea for realizing automatic adjustment of the humidity of a given gas through utilization of this phenomenon. They carried on the study with a view to reducing this idea to practice and have consequently perfected this invention.

It is known in the art that the saturated aqueous solution of a salt, when placed in a closed container, gives to the aerial phase in the interior of the container a fixed value of humidity depending on the particular kind of salt being used in the solution. [E. W. Washburn, Ed., International Critical Tables (McGraw-Hill, New York, 1926), Vol. 1, page 67]. It has been ascertained that when a gas is passed through this closed container in such a manner as to remain in contact with the saturated aqueous solution for an ample length of time during its passage through the container, the gas acquires humidity of a value closely approximating the value of humidity exhibited by the salt by the time the gas departs from the container. Further study and research conducted on the basis of this knowledge have led to perfection of the present invention aiming primarily to accomplish desired regulation of the humidity of a gas at the value exhibited by the salt by causing the gas to be passed successively through a multiplicity of pools of the saturated aqueous solution disposed inside a closed container. To be specific, vaporization of water is effected by removing the force of attraction exerted between the water molecules (dipole-dipole interaction) in an aqueous solution and, in introducing an aqueous salt solution into a container, it is necessary to consider the force of attraction exerted between the water molecules and ionized molecules (ion-dipole interaction) and the pressure of the vapor in the space within the container in addition to the aforementioned dipole-dipole interaction. In the present invention, however, since a saturated aqueous solution of salt is used, the ion concentration in the solution is kept constant and, consequently, the ion-dipole interaction is kept constant. Therefore, it can be inferred that the gas is at all times conferred with the humidity value exhibited by the salt. The invention will be described more specifically below with reference to the accompanying drawing.

Figure 1:
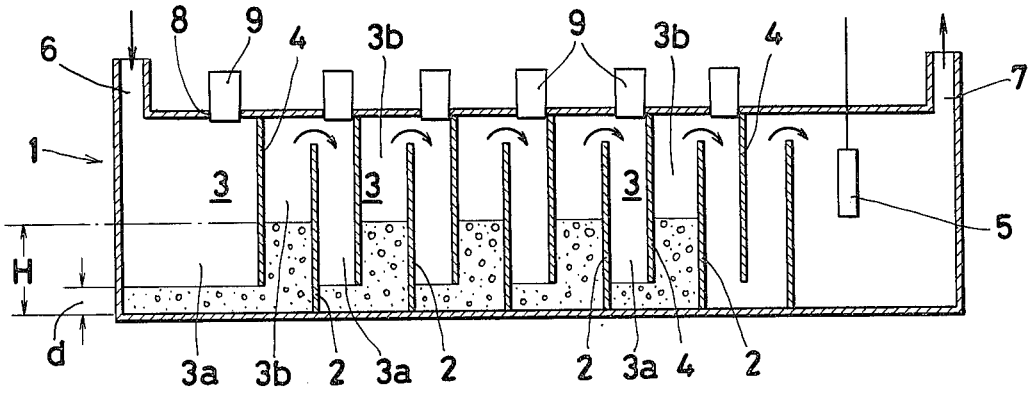
FIG. 1 is a sectioned view illustrating one preferred embodiment of the apparatus for adjusting the humidity of gas according to the present invention.

FIG. 1 represents one embodiment of the apparatus for the adjusting the humidity of a gas according to the present invention. Inside a horizontally elongate closed container 1, a plurality of partition walls 2 containing an opening of a minor height at the uppermost ends thereof are planted at fixed intervals to divide the container interior into smaller compartments 3. A plurality of partition walls 4 are hung down from the inside upper face of the closed container at intervals so as to divide the aforementioned compartments 3 each into two equal sub-compartments 3*a*, 3*b*. The lower ends of these partition walls 4 come short of reaching the inside bottom face of the container 1. The hanging partition walls and the rising partition walls jointly give rise to a zigzagging path inside the closed container 1. In the upper wall of the container 1 directly above the individual compartments 3, there are provided supply ports 8 adapted to introduce the saturated aqueous solution of salt or the salt in its powdered form or water for dilution of the aqueous solution. These ports 8 are kept tightly closed with rubber stoppers 9 when they are not in use. The container is provided at one upper end thereof with an inlet 6 for feed gas and at the other upper end thereof with an outlet 7 for the treated gas. The container 1 is further provided near the outlet 7 with a humidity sensor 5 adapted to measure the humidity of the treated gas.

In the apparatus of the illustrated embodiment, the first compartment with which the gas comes into contact upon entering the container is given a larger inner volume than any other compartment because the aqueous solution is vigorously evaporated particularly in this compartment. The compartment immediately preceding the compartment incorporating the humidity sensor is kept empty of the aqueous solution lest the humidity sensor should be directly exposed to splashes of the saturated aqueous solution of salt. The special considerations given to these particular compartments are simply expedient to enhance the convenience of the operation of the apparatus.

In the apparatus for the regulation of the humidity of a gas constructed as described above, the saturated aqueous solution of a salt prepared as prescribed is introduced via the supply ports 8 into the respective compartments 3 at least to a height sufficient to keep the lower ends of the hanging partition walls 4 submerged in the solution. Then the gas subjected to treatment is introduced under pressure via the inlet 6 into the container. The incoming gas, on entering the sub-compartment 3*a* of the first compartment, passes in the form of bubbles into the saturated aqueous solution of salt and passes under the lower end of the partition wall 4 to reach the sub-compartment 3*b*. On reaching the sub-compartment 3*b*, the bubbles ascend through the saturated aqueous solution of salt and then collect into a mass of gas above the surface. The mass of gas flows over the upper end of the partition wall 2 and enters the sub-compartment 3*a* of the second compartment, wherein it passes in the form of bubbles into the saturated aqueous solution of salt and moves to the adjoining sub-compartment 3*b* similarly as in the first compartment.

As the gas passes through the successive pools of the saturated aqueous solution of salt in the manner described above, it gradually accumulates humidity up to the final level which approximates the value of humidity exhibited by the salt. When the gas passes through the saturated aqueous solution of salt, the water component of the saturated aqueous solution of salt is entrained by the passing gas. As the passage of the gas continues and the water component is gradually lost from the saturated aqueous solution of salt, the salt in the solution crystallizes out. Eventually the water component is totally lost and only crystals of the salt remain. To prevent the total loss of the water component, the saturated aqueous solution in the compartments is diluted from time to time with new supply of the aqueous solution or plain water introduced through the respective supply ports 8.

The size of the apparatus to be used in the present invention and the number of compartments to be formed in the apparatus are not specifically limited. The essential requirement is that the apparatus should be constructed so as to enable the gas under treatment to be brought into contact with the saturated aqueous solution of salt for an ample length of time for the gas to acquire a desired level of humidity. The size of the apparatus and the number of compartments, therefore, are determined in due consideration of the feed volume of the gas, the shape of individual compartments, the condition in which the saturated aqueous solution of salt and the gas come into mutual contact, etc.

Further, an indication of whether the treated gas is being given the desired humidity value can be obtained by checking whether the treated gas is of a constant humidity value. If it is, the humidity value can be presumed to be the desired one.

To cite a typical size of the apparatus, the container 1 is 350 mm in overall length, 80 mm in height, 50 mm in width, 20 mm in distance between the adjacent partition walls 2 and 4, 10 mm in distance d between the lower end of the partition wall 4 and the bottom of the container 1 and 50 mm in height H of the saturated aqueous solution of salt placed in the respective compartments of the container. In the size mentioned above, the apparatus has a construction such that the gas comes into contact with the saturated aqueous solution of salt a total of five times during its passage through the apparatus. In this case, the gas satisfactorily acquires a humidity of the value exhibited by the salt when the gas is passed at a feed volume within the range of from 10 to 100 cc/min.

The material of which the aforementioned apparatus of the present invention is formed is only required to be chemically stable upon exposure to the saturated aqueous solution of salt to be used. Since the apparatus is not operated under harsh conditions, it can be formed of a material selected from a wide variety of materials. Although the material thus selected is not necessarily required to be transparent, it is more advantageous for it to be transparent than otherwise because the apparatus, when made of a transparent material, permits ready inspection of the condition of passage of the gas through the pools of the saturated aqueous solution, the crystallization of salt in the aqueous solution and other phenomena taking place within the apparatus.

From this point of view, rigid, transparent polyvinyl chloride may be cited as one typical material which proves particularly advantageous for the purpose.

The salt of which the saturated aqueous solution is prepared for use in the apparatus of this invention can be selected from a wide variety of salts. Examples of such salts include $KNO_2$, $Mg(NO_3)_2.6H_2O$, $NaNO_2$, $NaClO_3$, $NH_4Cl$, KBr, $NH_4H_2PO_4$, $NaBr.2H_2O$, NaCl, $KHSO_4$, $NaNO_3$, KCNS, $KNO_3$, $CrO_3$, KI, $K_2CO_3.2H_2O$, $Mg(CH_3COO)_2.H_2O$, $NH_4NO_3$, $(NH_4)_2SO_4$ and $Na_2CO_3.10H_2O$ and mixtures thereof.

For use in the apparatus, the salt selected from the foregoing group is dissolved in water so that the resultant aqueous solution is saturated to a point where the salt is partly crystallized out in the solution. The saturated aqueous solution of salt prepared in the form described above may be directly placed in the compartments 3 of the apparatus or the salt in its powdery state may be placed therein first and water added subsequently to dilute the salt to a prescribed concentration.

The humidity to which the gas is desired to be adjusted can easily be attained by suitably selecting the salt to be used for the saturated aqueous solution. A gas having a relative humidity on the order of 42 to 46% (the variation within the indicated range depending on the change in the ambient temperature) is obtained when the gas is treated with a saturated aqueous solution of $KNO_2$, for example. When the treatment of the gas is carried out with a saturated aqueous solution of $NH_4H_2PO_4$, the gas acquires a relative humidity on the order of 90 to 95%.

Air is typical of the gases which can be adjusted in humidity by the method of this invention are represented by air but other gases which are insoluble in water and are not reactive with the saturated aqueous solution can also be treated. Specifically, such gases include hydrogen, oxygen and various inert gases. Mixtures of such gases may also be treated by the present invention.

Concerning the shape of the apparatus of the present invention, although an apparatus having the shape of a horizontally elongate rectangular parallelepiped is illustrated in FIG. 1, the apparatus may be in any other form insofar as it is constructed so that the interior thereof is divided with partition walls into a plurality of compartments as described previously. For example, the apparatus may be constructed in a spiral design. Otherwise, the apparatus may be formed by preparing a plurality of containers each provided with one inner partition wall, an inlet for feed gas and an outlet for the treated gas, joining these containers end to end and connecting the outlets of the preceding containers to the inlets of the respectively subsequent containers. In this apparatus, the individual containers are filled with the saturated aqueous solution of salt and the gas under treatment is introduced under pressure into the first container via the inlet thereof and passed successively through the remaining containers. Depending on the design of the apparatus, the operating condition of the apparatus, etc., the gas under treatment may be blown into the saturated aqueous solution of salt in the form of fine bubbles. In this case, the duration of contact between the gas and the saturated aqueous solution of salt may be decreased.

As is clear from the description given above, this invention enables the gas to acquire a desired value of humidity by causing the gas to come into contact with the saturated aqueous solution of salt. So long as one and the same salt is used for this treatment, the gas having a prescribed value of humidity can be constantly obtained by the present invention.

The gas thus produced does not contain any vapor of the salt. When the gas is supplied to various apparatuses, laboratories, rooms for the culture of microorganisms, for example, their interior spaces can be maintained constantly at a fixed level of humidity.

In an extreme case, the device to be used for bringing the gas into contact with the saturated aqueous solution may consist solely of means for blowing the gas into the saturated aqueous solution of salt and means for supplying diluting water to the saturated aqueous solution of salt. Water is the only material consumed in the operation of the apparatus of this invention. Thus, the apparatus of the present invention permits a gas possessed of a fixed value of relative humidity to be produced conveniently and economically for a prolonged period of time.

Now, the present invention will be described below with reference to examples. It should be noted that this invention is not limited to these examples.

EXAMPLE 1

In a container made of rigid, transparent polyvinyl chloride and having an inside length of 350 mm, an inside height of 80 mm and an inside width of 50 mm, partition walls 4 and 2 were alternately disposed at fixed intervals of 20 mm, with the lower ends of the partition walls 4 separated by a distance of 10 mm from the bottom of the container and the upper ends of the partition walls 2 rising to a height of 70 mm from the bottom of the container. Thus was formed an apparatus constructed as illustrated in FIG. 1 and provided with a total of five compartments to be filled with the saturated aqueous solution of salt. Air at room temperature was blown into the apparatus at a flow rate of 50 cc/min via the inlet (8 mm in diameter). The saturated aqueous solution of one of the salts indicated in the Table below (18 salts) was placed in the compartments to a height of about 30 mm. Continuously for 48 hours, the air emanating through the outlet was tested for humidity. The maximum and minimum values of humidity found for the air are shown in the Table. During the measurement of the humidity, the saturated aqueous solutions were checked for possible crystallization of salts. In all the solutions, however, only negligibly small amounts of crystals of salts had been newly formed after 24 hours of operation.

| Salts | Relative Humidity (%) | Salts | Relative Humidity (%) |
|---|---|---|---|
| $KNO_2$ | 42–46 | $NaNO_3$ | 73–80 |
| KCNS | 45–51 | $(NH_4)_2SO_4$ | 77–85 |
| $Mg(NO_3)_2.6H_2O$ | 53–58 | $NH_4Cl$ | 78–82 |
| $NaBr.2H_2O$ | 57–62 | KBr | 80–84 |
| $NaNO_2$ | 63–66 | $KHSO_4$ | 82–90 |
| $NH_4NO_3$ | 63–71 | KCl | 83–89 |
| KI | 69–74 | $KNO_3$ | 89–94 |
| NaCl | 72–80 | $NH_4H_2PO_4$ | 90–95 |
| $NaClO_3$ | 73–77 | $NaHCO_3$ | 91–96 |

It is seen from the Table that the humidity of the emanating air varied widely from one salt to another used in the treatment. The considerable difference involved in each set of found values may be ascribed to changes which occurred in the ambient temperature during the measurement. At 20° C., the values of humidity found of all the salts tested fall within the respective ranges indicated in the Table, suggesting that the measurement had tolerable reproducibility. In each test run, the air resulting from the treatment was sampled and assayed by gas and mass spectroscopy to ascertain that it entrained absolutely no vapor of the salt.

In the same apparatus, the procedure described above was repeated by using KCl as the salt for the saturated aqueous solution and hydrogen and argon besides air as the gas subjected to treatment. Similarly to air, the gases emanating from the apparatus were invariably found to possess about 85% of humidity.

EXAMPLE 2

Figure 2:
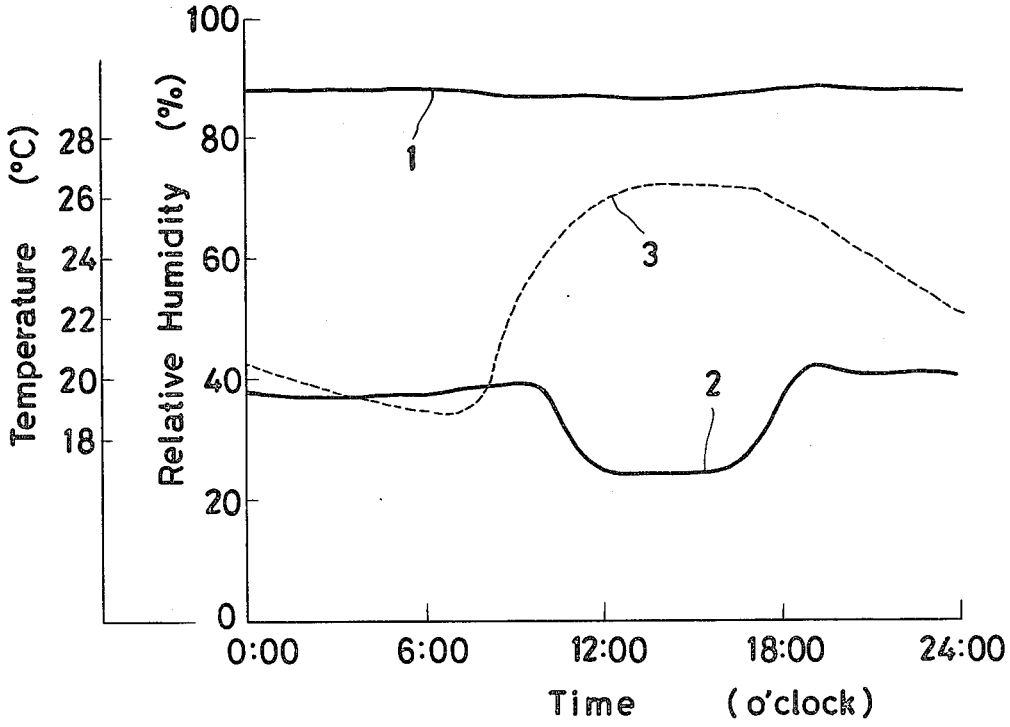
FIG. 2 is a graph showing the relation between the humidity and temperature of the gas which is treated by the operation of the apparatus of the present invention.

The compartments in the apparatus of the same construction as illustrated in FIG. 1 were supplied with the saturated aqueous solution of KCl. Into this apparatus, air was blown in at a feed rate of 50 cc/min. The air emanating from the apparatus was led into a closed container having an internal volume of 1000 cc and provided with an outlet 8 mm in diameter. For 24 hours, the air inside this container was tested for humidity. The results are shown in the graph of FIG. 2. For referential purposes, the time-course changes in temperature and humidity inside the room in which the container was placed are also shown in FIG. 2. In the graph of FIG. 2, the curve 1 represents the change in humidity inside the container, the curve 2 the change in humidity inside the room and the curve 3 the change in room temperature respectively. It is seen from the graph of FIG. 2 that the room temperature began to rise around 8 o'clock in the morning, rose over 26° C. at 12 o'clock and.began to fall gradually from about 5 o'clock in the afternoon. The humidity inside the room fell from about 40% to about 25% as the temperature rose. For the same change in room temperature, the humidity inside the container changed by only a few percentage points. This fact indicates that the gas treated by the method of this invention continues to acquire a substantially constant value of humidity without necessitating any special control of the ambient temperature so far as the change in the ambient temperature remains within a limited range.

What is claimed is:

1. A method of adjusting the humidity of a gas to a constant value, comprising:

passing said gas through a plurality of successive compartments in a closed container each containing a saturated aqueous solution of a salt containing crystals of said salt thereby intimately contacting said gas with said saturated salt solution as the gas passes through the salt solution in each of said compartments, the humidity of the gas exiting said container being essentially the same as the humidity level for an atmosphere in equilibrium with said aqueous salt solution.

2. The method according to claim 1, wherein the gas is brought into intimate contact with the saturated aqueous solution of a salt by being passed therethrough.

3. The method according to claim 1, wherein the intimate contact of the gas with the saturated aqueous solution of a salt is accomplished by blowing the gas into the aqueous solution.

4. The method according to claim 1, 2 or 3, wherein the gas is brought into contact with the saturated aqueous solution of a salt a plurality of times.

5. The method according to claim 1, wherein the salt is at least one member selected from the group consisting of KCl, $NaClO_3$, $NaNO_2$, $NaBr.2H_2O$ and $KNO_2$.

6. The method according to claim 1, 2 or 3, wherein said gas is air.

7. The method of claim 1 wherein the salt of said saturated aqueous salt solution is selected from the group consisting of $KNO_2$, $Mg(NO_3)_2.6H_2O$, $NaNO_2$, $NaClO_3$, $NH_4Cl$, KBr, $NH_4H_2PO_4$, $NaBr.2H_2O$, NaCl, $KHSO_4$, $NaNO_3$, KCNS, $KNO_3$, $CrO_3$, KI, $K_2CO_3.2H_2O$, $Mg(CH_3COO)_2.H_2O$, $NH_4NO_3$, $(NH_4)_2SO_4$, $Na_2CO_3.10H_2O$ and mixtures thereof.

8. The method of claim 1, wherein said gas is hydrogen or oxygen.

* * * * *